US008246219B2

(12) United States Patent
Teng et al.

(10) Patent No.: US 8,246,219 B2
(45) Date of Patent: Aug. 21, 2012

(54) LIGHT EMITTING DIODE LIGHT MODULE AND OPTICAL ENGINE THEREOF

(75) Inventors: Yen Chu Teng, Hsinchu County (TW); Chia Chen Chang, Yilan County (TW); Wei Hung Wu, Kaohsiung (TW); Shang Te Tu, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 376 days.

(21) Appl. No.: 12/608,500

(22) Filed: Oct. 29, 2009

(65) Prior Publication Data

US 2010/0110679 A1 May 6, 2010

(30) Foreign Application Priority Data

Nov. 4, 2008 (TW) ..... 97142449 A

(51) Int. Cl.
*F21V 3/00* (2006.01)

(52) U.S. Cl. ..... 362/311.03; 362/217.02; 362/294

(58) Field of Classification Search ..... 362/294, 362/311.02, 311.03, 311, 311.09, 326, 217.02, 362/217.04, 217.1
See application file for complete search history.

(56) References Cited

U.S. PATENT DOCUMENTS

| | | | | |
|---|---|---|---|---|
| 6,517,218 | B2 * | 2/2003 | Hochstein | 362/294 |
| 7,008,079 | B2 * | 3/2006 | Smith | 362/235 |
| 7,407,307 | B2 * | 8/2008 | Hiratsuka | 362/304 |
| 7,753,568 | B2 | 7/2010 | Hu et al. | |
| 7,922,354 | B2 * | 4/2011 | Everhart | 362/235 |
| 7,997,760 | B2 * | 8/2011 | Suzuki et al. | 362/249.01 |
| 2004/0222516 | A1 | 11/2004 | Lin et al. | |
| 2006/0126343 | A1 | 6/2006 | Hsieh et al. | |
| 2006/0291201 | A1 | 12/2006 | Smith et al. | |
| 2007/0201225 | A1 | 8/2007 | Holder et al. | |
| 2007/0217192 | A1 | 9/2007 | Hiratsuka et al. | |

FOREIGN PATENT DOCUMENTS

| | | | |
|---|---|---|---|
| CN | 2859197 | Y | 1/2007 |
| CN | 201059523 | Y | 5/2008 |
| CN | 101202270 | A | 6/2008 |
| CN | 201096283 | Y | 8/2008 |
| CN | 101290958 | A | 10/2008 |

* cited by examiner

*Primary Examiner* — Ali Alavi
(74) *Attorney, Agent, or Firm* — Altis Law Group, Inc.

(57) ABSTRACT

An optical engine of a light emitting diode (LED) light module comprises a heat dissipation device, an LED light bar and an optical component. The heat dissipation device comprises a base plate and a plurality of fin plates vertically welded onto a surface of the base plate. The LED light bar is disposed on an opposite surface of the base plate so that the LED light bar can dissipate heat through the fin plates. The optical component having a space for accommodating the LED light is provided to form a desired light distribution pattern.

20 Claims, 17 Drawing Sheets

LIGHT EMITTING DIODE LIGHT MODULE AND OPTICAL ENGINE THEREOF

BACKGROUND OF THE INVENTION

1. Field of the Invention

The present invention relates to an optical engine, and relates more particularly to an optical engine using light emitting diodes to emit light and a lightweight heat dissipation device to dissipate heat.

2. Description of the Related Art

Light emitting diodes (LED) have superior characteristics such as low power consumption, high-energy conversion efficiency, long lifespan, and lack of mercury pollution, making the light emitting diode a good candidate for the replacement of traditional illumination devices. For example, a combined high power LED street light needs only one quarter the amount of electricity that an incandescent lamp consumes, and has a lifespan 10 times as long. Such amazing energy-saving performance has attracted widespread attention, and many areas have plans to deploy LED street lights for replacement of traditional street lights.

In order to facilitate widespread application of LEDs, LED lamps that are convenient to use have to be developed. To this end, several LED lamps have been proposed. U.S. Patent Publication No. 2006/0,291,201 A1 discloses a side emitting collimator. The side emitting collimator comprises an LED light source emitting light. An optical element reflects the emitting light laterally, and angled reflecting surfaces reflect the laterally reflected light forward to form parallel beams incident on an object, wherein one optical element is disposed with respect to one LED light source, and the LED light source is attached to a metal block for heat dissipation so as to dissipate heat from the LED.

Further, U.S. Patent Publication No. 2007/0,217,192 A1 discloses an illuminating panel and an illuminating device. A light emitter includes a plurality of light emitting diodes. Reflectors are provided to reflect light from the light emitting diodes toward an illuminated body. A light emitter and reflectors are assembled on a base to form the illuminating panel.

In addition, U.S. Patent Publication No. 2007/0,201,225 A1 discloses an LED device for wide beam generation. An optical lens is disposed on a plurality of light emitting diodes arrayed on a printed circuit board. The assembly module of the optical lens, the light emitting diodes and the printed circuit board are disposed on a substrate, which is capable of heat dissipation. A plastic cover is disposed on the assembly module to obtain an optical engine.

SUMMARY OF THE INVENTION

The present invention provides an LED (light emitting diode) light module and an optical engine thereof. The number of optical engines, which are electrically, optically, and mechanically integrated, disposed in the LED light module can arbitrarily change in order to meet luminosity requirements. The optical engine includes a systematic power source, and therefore it can directly connect to a municipal power supply. A heat dissipation device is included and can easily be increased or decreased in size according to the heat dissipation requirement, and the weight of the heat dissipation device can be reduced by use of fin plates.

One embodiment of the present invention provides an optical engine of an LED light module. The optical engine comprises a heat dissipation device, an LED light bar, and an optical component. The heat dissipation device comprises a base plate and a plurality of fin plates vertically disposed on a surface of the base plate. The LED light bar is disposed on an opposite surface of the base plate, thereby dissipating heat through the heat dissipation device. The optical component has a space for receiving the LED light bar, configured for provision of a predetermined light distribution pattern.

One embodiment of the present invention provides an LED light module, which comprises a frame and a plurality of the above-mentioned optical engines. The frame comprises a plurality of reflecting plates protruding from a surface of the frame and a plurality of hollowed-out regions formed on the frame, wherein the plurality of reflecting plates are arrayed along a direction transverse to the longitudinal direction of the reflecting plates, and the hollowed-out regions are respectively formed between every two adjacent reflecting plates.

Compared to a traditional combination of a light source and a module, the embodiments of the present invention can have multiple rows of light emitting diodes. In addition, compared to the use of metal block for heat dissipation, the heat dissipation device can have a lighter weight and more efficient heat dissipation area. Moreover, the components of the optical engine of the present invention need not use a precisely manufactured die, and therefore its cost is low.

To better understand the above-described objectives, characteristics and advantages of the present invention, embodiments, with reference to the drawings, are provided for detailed explanations.

BRIEF DESCRIPTION OF THE DRAWINGS

The invention will be described according to the appended drawings in which.

DETAILED DESCRIPTION OF THE INVENTION

Figure 1:
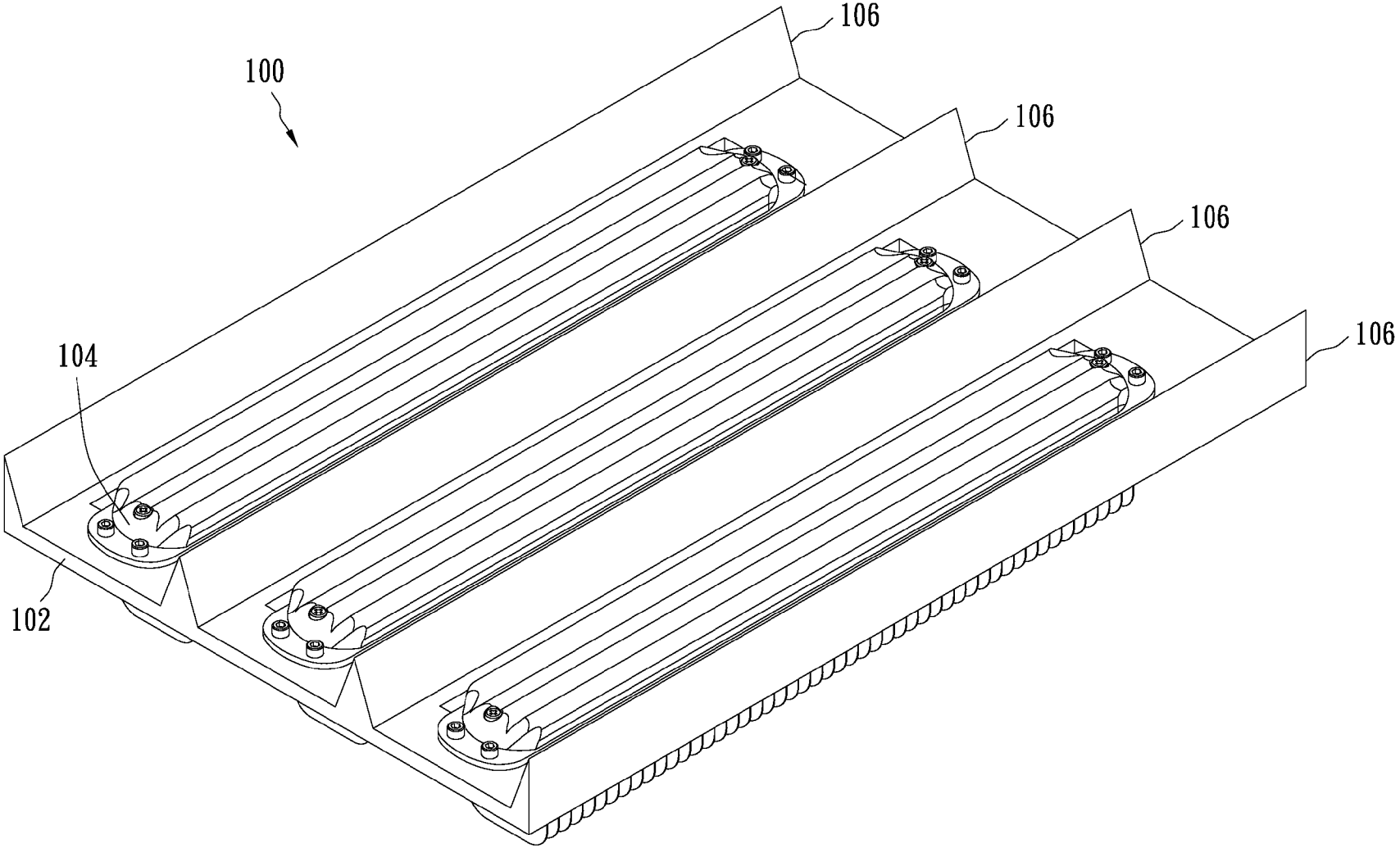
FIG. 1 is a perspective view showing a light emitting diode (LED) light module according to one embodiment of the present invention.

FIG. 1 is a perspective view showing a light emitting diode (LED) light module 100 according to one embodiment of the present invention. The LED light module 100 comprises a frame 102 and a plurality of optical engines 104. The frame 102 has a surface, from which a plurality of elongated reflecting plates 106 arrayed along a direction transverse to the longitudinal direction of the reflecting plates 106. Each spaced area between two adjacent reflecting plates 106 includes a hollowed-out region, in which the respective optical engine 104 is disposed. With such an arrangement, light laterally emitted from each optical engine 104 can be reflected following the direction along the positive optical axis of the optical engine 104 by two reflecting plates 106 adjacent to the optical engine 104.

Figure 2:
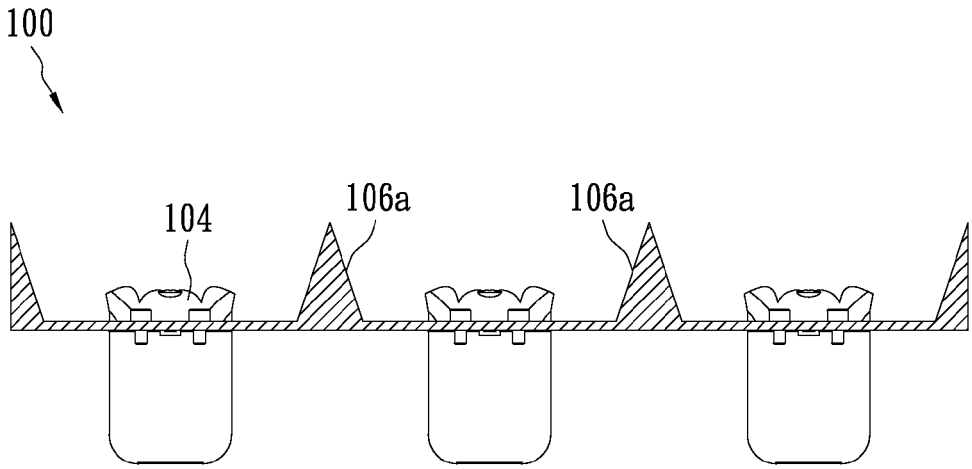
FIG. 2 is a cross-sectional view showing an LED light module according to one embodiment of the present invention.
Figure 3:
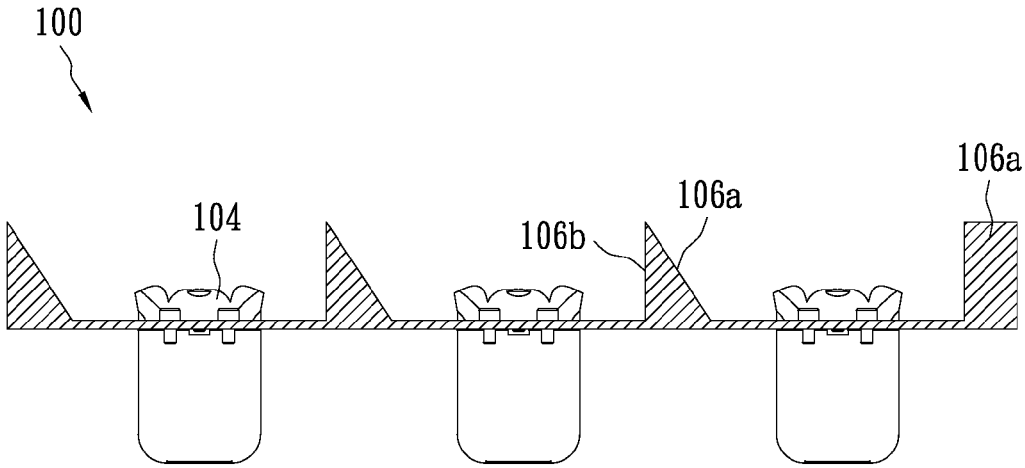
FIG. 3 is a cross-sectional view showing an LED light module according to another embodiment of the present invention.

Referring to FIGS. 2 and 3, each reflecting plate 106 may comprise two inclined reflecting surfaces 106*a* or one inclined surface 106*a* and one straight surface 106*b*. The incline angle of the inclined surface 106*a* is configured corresponding to the manner of the light laterally emitted from the optical engine 104 so that the light laterally emitted from the optical engine 104 can be reflected parallel to the positive optical axis of the optical engine 104 by two adjacent reflecting plates 106, wherein the surface of the reflecting plate 106 can be a polished aluminum surface.

The present invention discloses an LED light module 100, which is a simple assembly of a frame 102 and a plurality of optical engines 104 arrayed and firmly attached to the frame 102. The LED light module 100 can be easily expanded according to the required luminous flux, merely by using a frame 102 of suitable size, to which optical engines 104 are firmly attached. The frame 102 can be formed using a stamping process, or can be assembled from a plurality of extruded aluminum elements.

Figure 4:
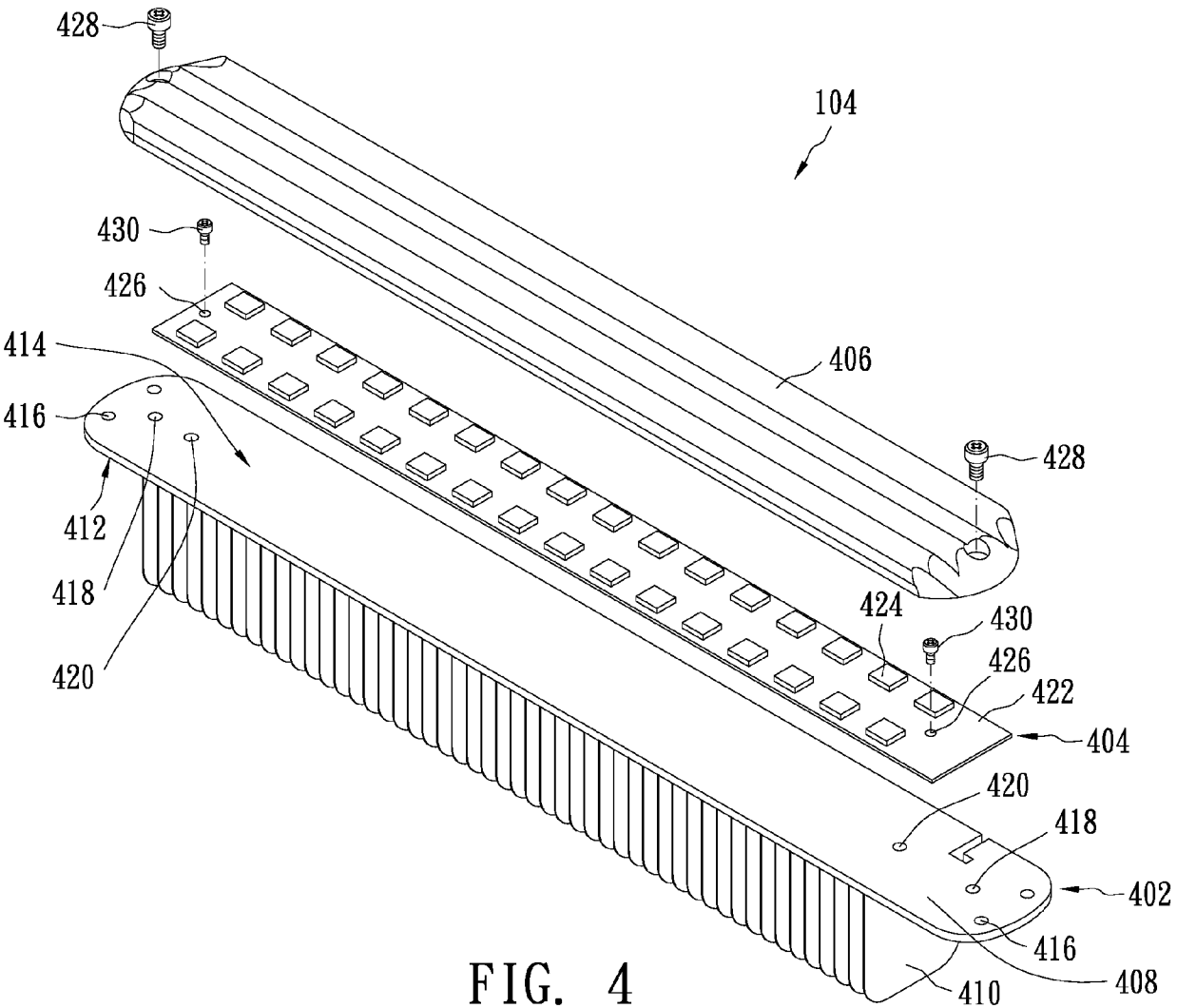
FIG. 4 is an exploded perspective view showing an optical engine according one embodiment of the present invention.
Figure 5:
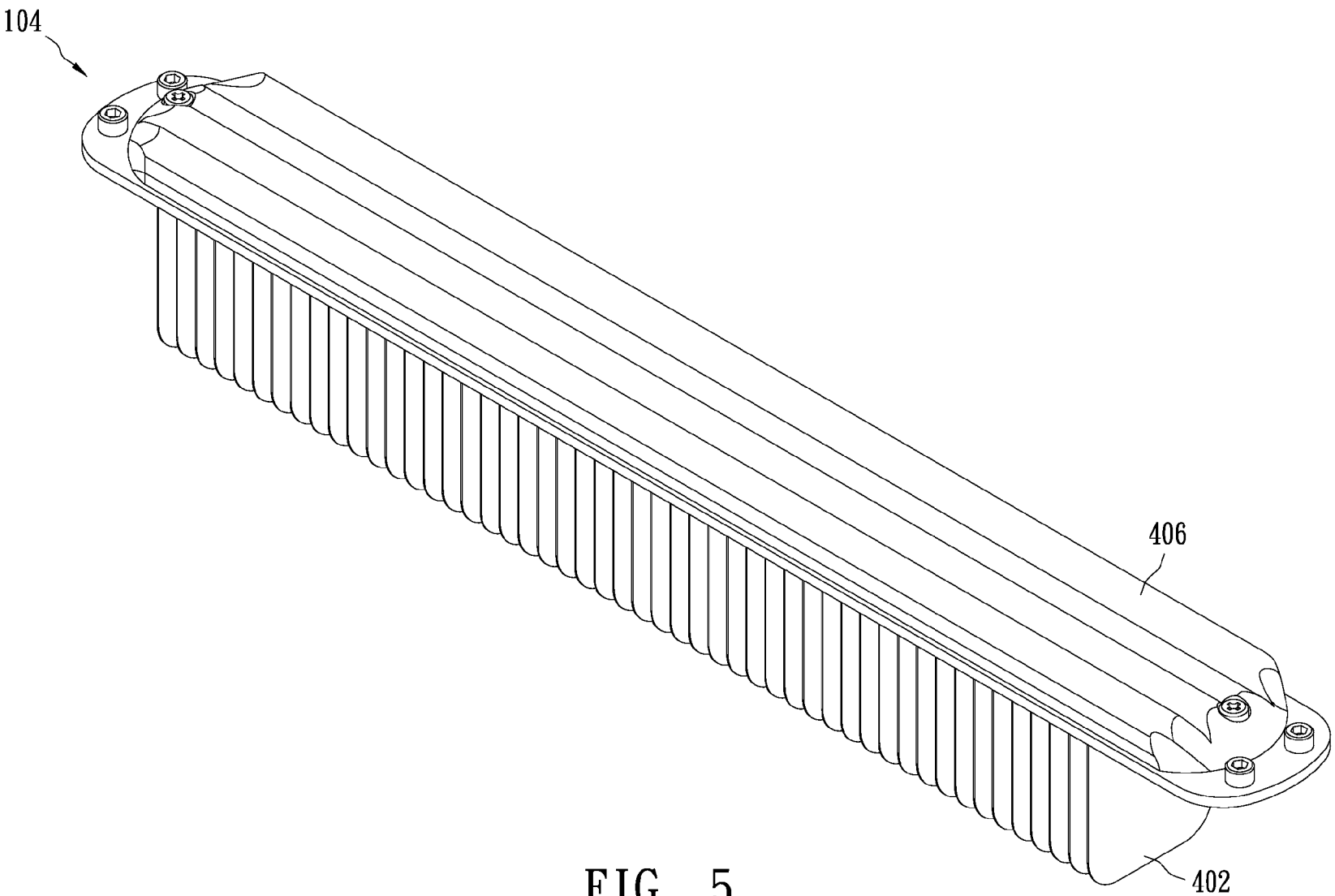
FIG. 5 is a perspective view showing an optical engine according to one embodiment of the present invention.

Referring to FIGS. 4 and 5, the optical engine 104 comprises a heat dissipation device 402, an LED light bar 404, and an optical component 406. The heat dissipation device 402 comprises a base plate 408 and a plurality of fin plates 410. The base plate 408 and the fin plate 410 can be two separate components. The fin plate 410 can be formed by stamping high thermally conductive material such as aluminum and copper. The fin plates 410 can be equally spaced, arrayed in opposed face-to-face aligned relationship, and arranged vertically on a surface 412 of the base plate 408 such that the optical engine 104 can have sufficient heat dissipation area. Each of the two longitudinally spaced edge portions comprises two holes 416 configured for receiving screws for fastening the optical engine 104 to the frame 102 of an LED light module 100. In addition, each of the two longitudinally spaced edge portions further comprises another two holes 418 and 420 configured to receive screws to fasten an LED light bar 404 and an optical component 406.

Figure 6:
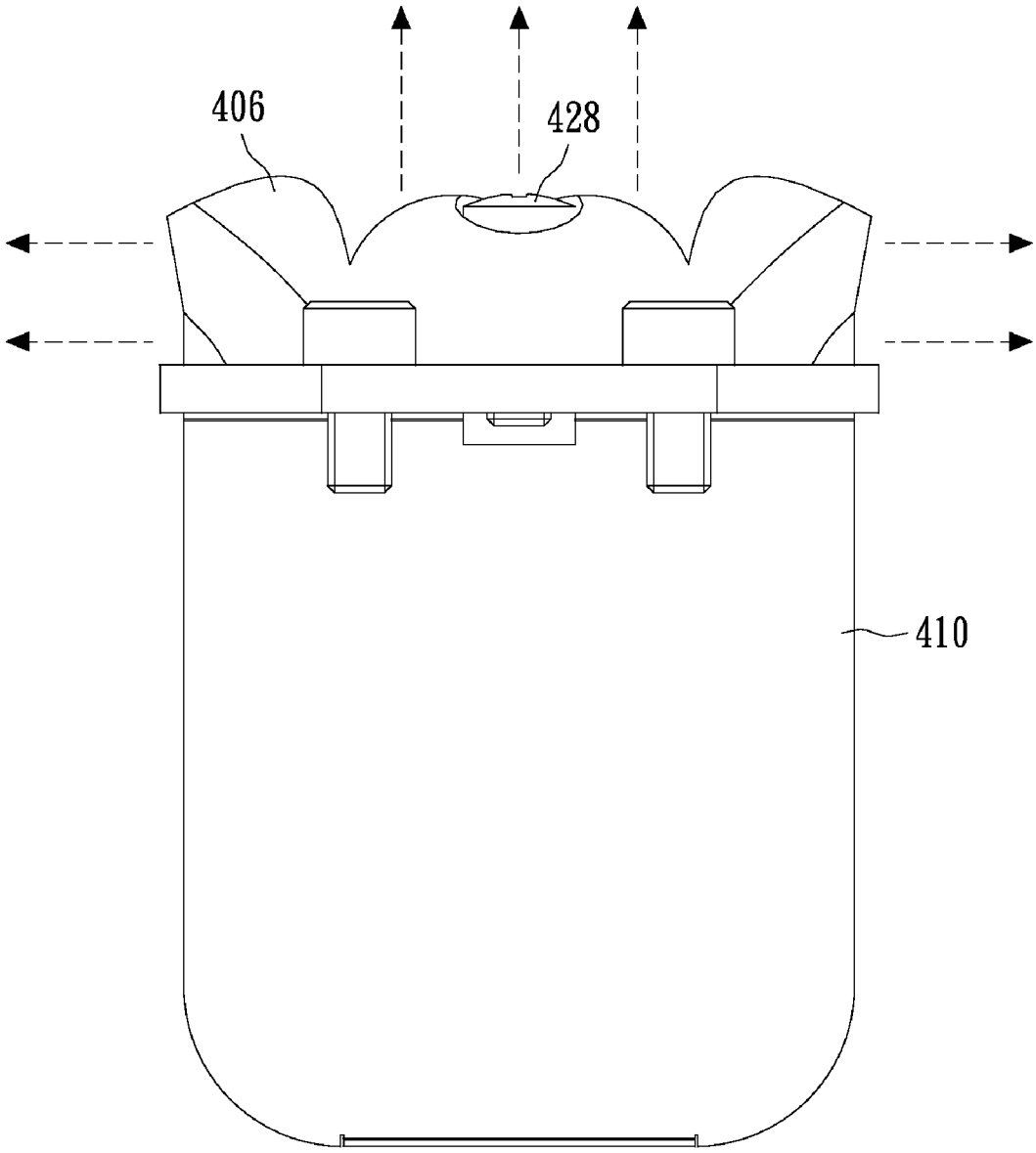
FIG. 6 is a side view showing an optical engine according to one embodiment of the present invention.

Referring to FIGS. 4 to 6, the LED light bar 404 comprises a plurality of light emitting diodes 424 longitudinally disposed along an elongated printed circuit board 422. The plurality of light emitting diodes 424 can be arrayed in a row. The printed circuit board 422 can be a metal core printed circuit board. Each of the two opposite end portions of the LED light bar 404 can include a hole 426 configured to receive screws to fasten the LED light bar 404 to the surface 414 of the base plate 408.

Figure 7:
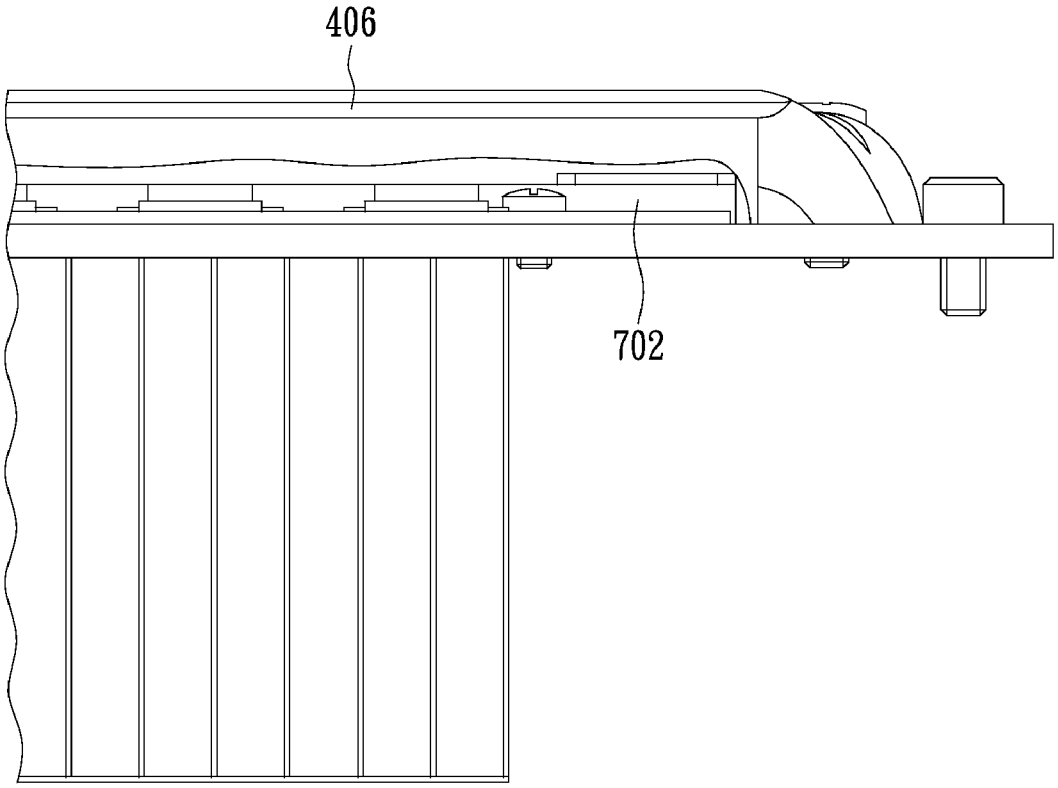
FIG. 7 is a front view showing an optical engine according to one embodiment of the present invention.

Referring to FIGS. 4 to 7, the optical component 406 is disposed on the light emitting side of the LED light bar 404 and can be fastened to the substrate 408 using a fastener 428. The optical component 406 comprises an elongated light guide structure and has a space 702 for receiving an LED light bar 404 as shown in FIG. 7. After assembly, the space 702 can be filled with an encapsulating adhesive including silicon polymer or epoxy resin for waterproofing. The refractive index of the encapsulating adhesive is between the refractive index of the encapsulating adhesive in the light emitting diode 424 and the refractive index of the optical element 406 so as to lower the Fresnel loss and the critical angle loss, and to increase light emission efficiency. In the present embodiment, the fastener 428 includes a screw.

Referring to FIG. 6, the light guide structure of the optical element 406 can be a symmetrical structure, which comprises a plurality of elongated curved surfaces. Due to the different refractive indexes of two media that can result in total internal reflection, the combination of the above-mentioned curved surfaces can change the path of a portion of light emitted from the directional light emitting diodes 424, thereby reducing glare, obtaining a large and uniform luminous area, and forming a desired light distribution pattern.

Figure 8:
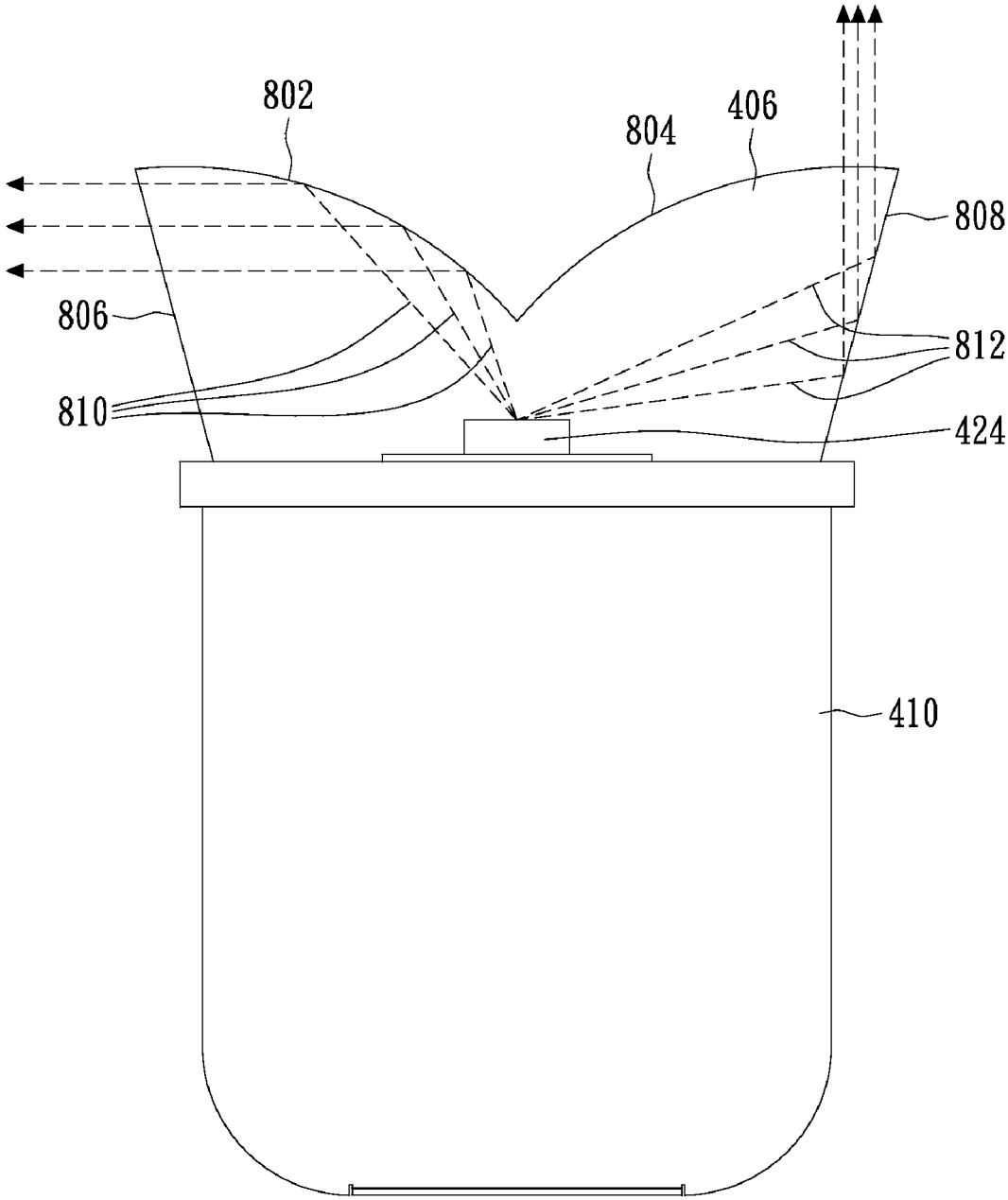
FIGS. 8 to 14 show the light guide structures of an optical element according to other embodiments of the present invention.
Figure 9:
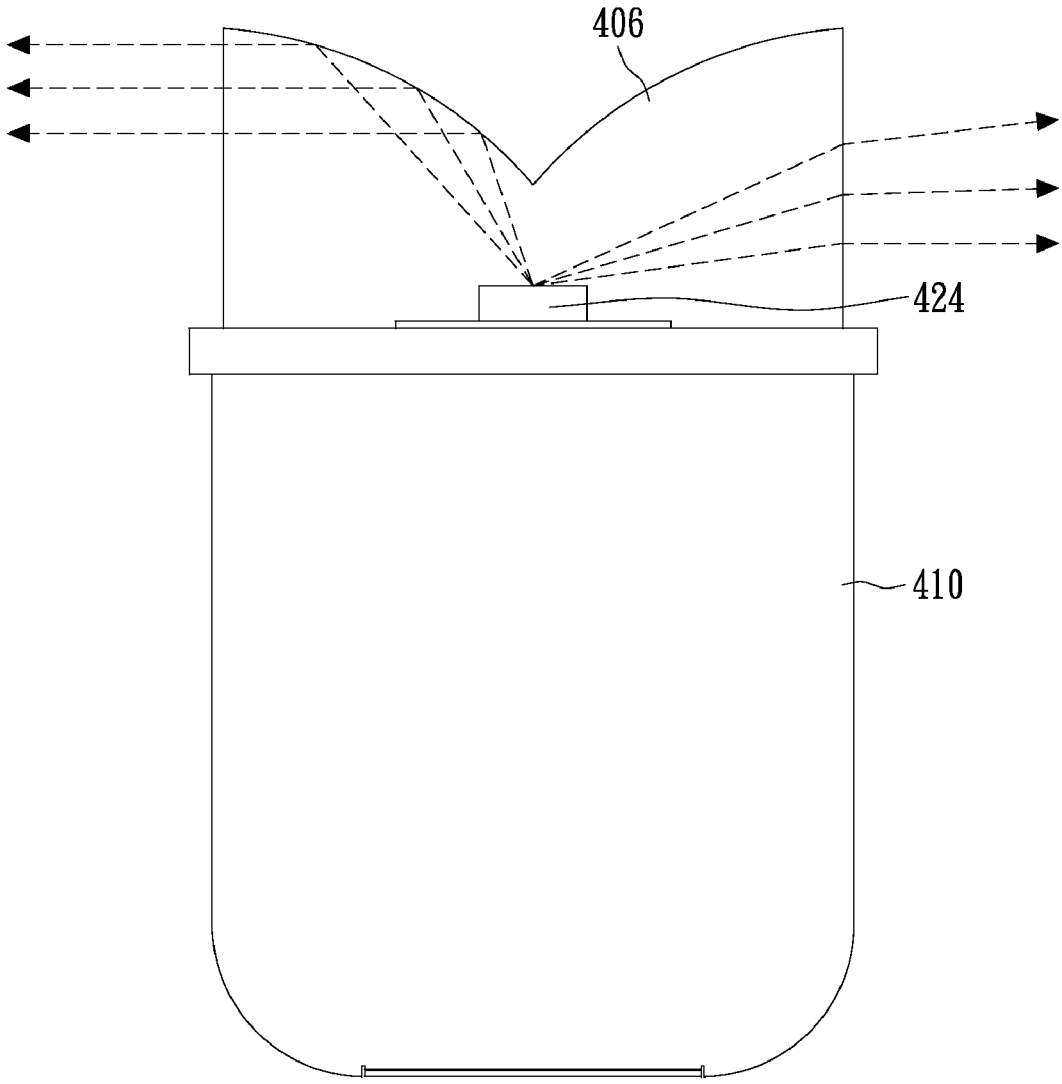
Figure 10:
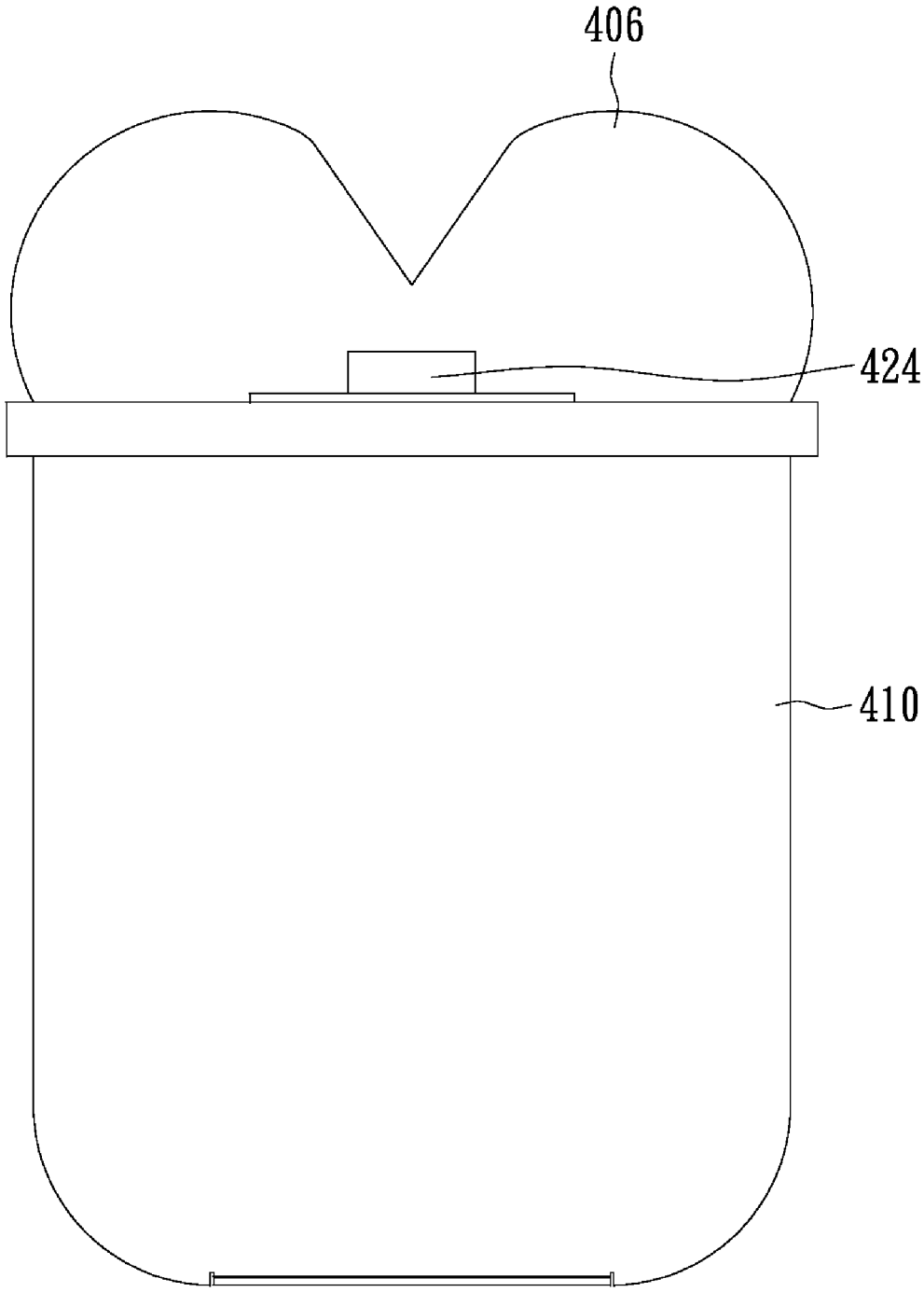
Figure 11:
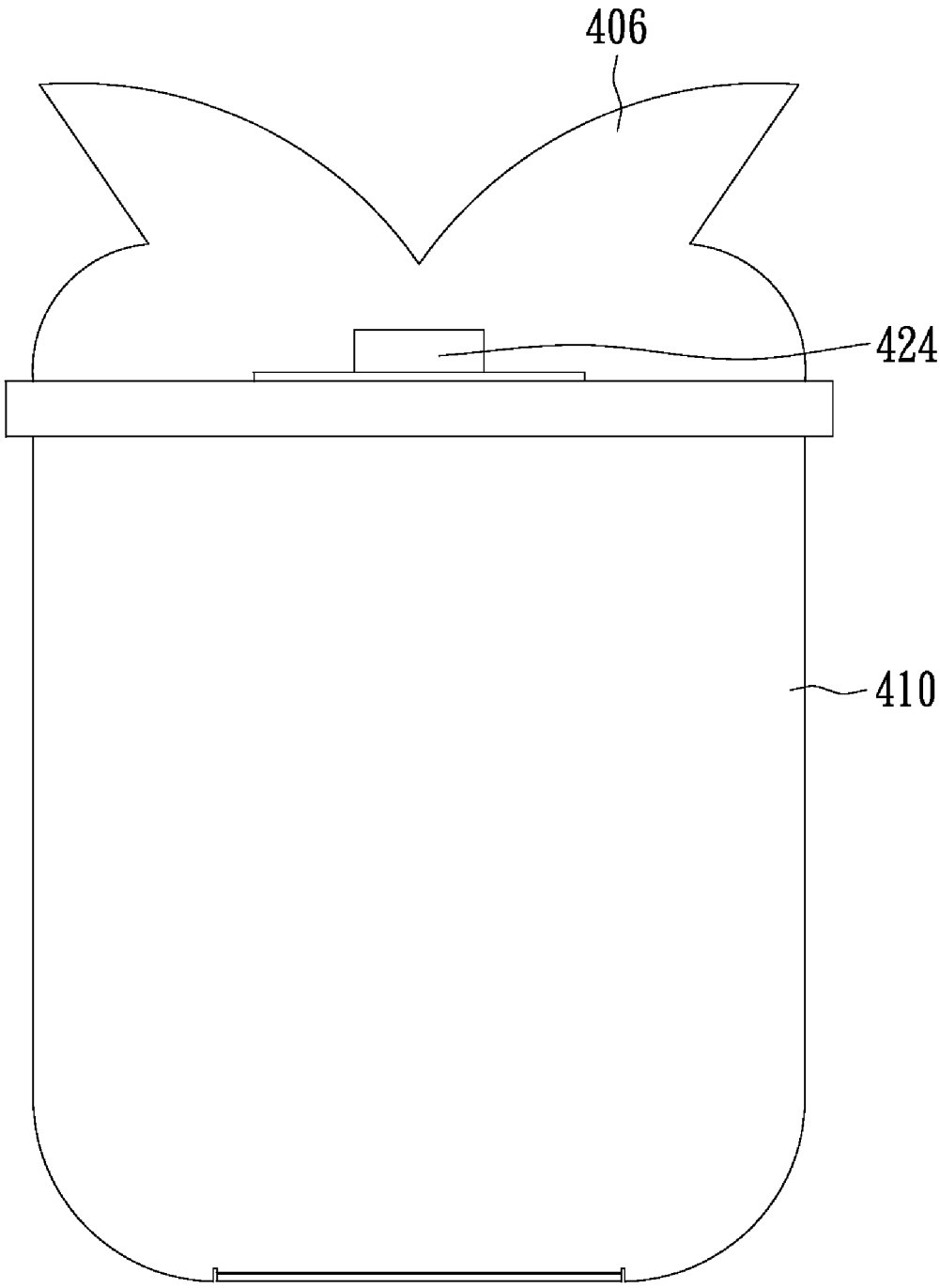
Figure 12:
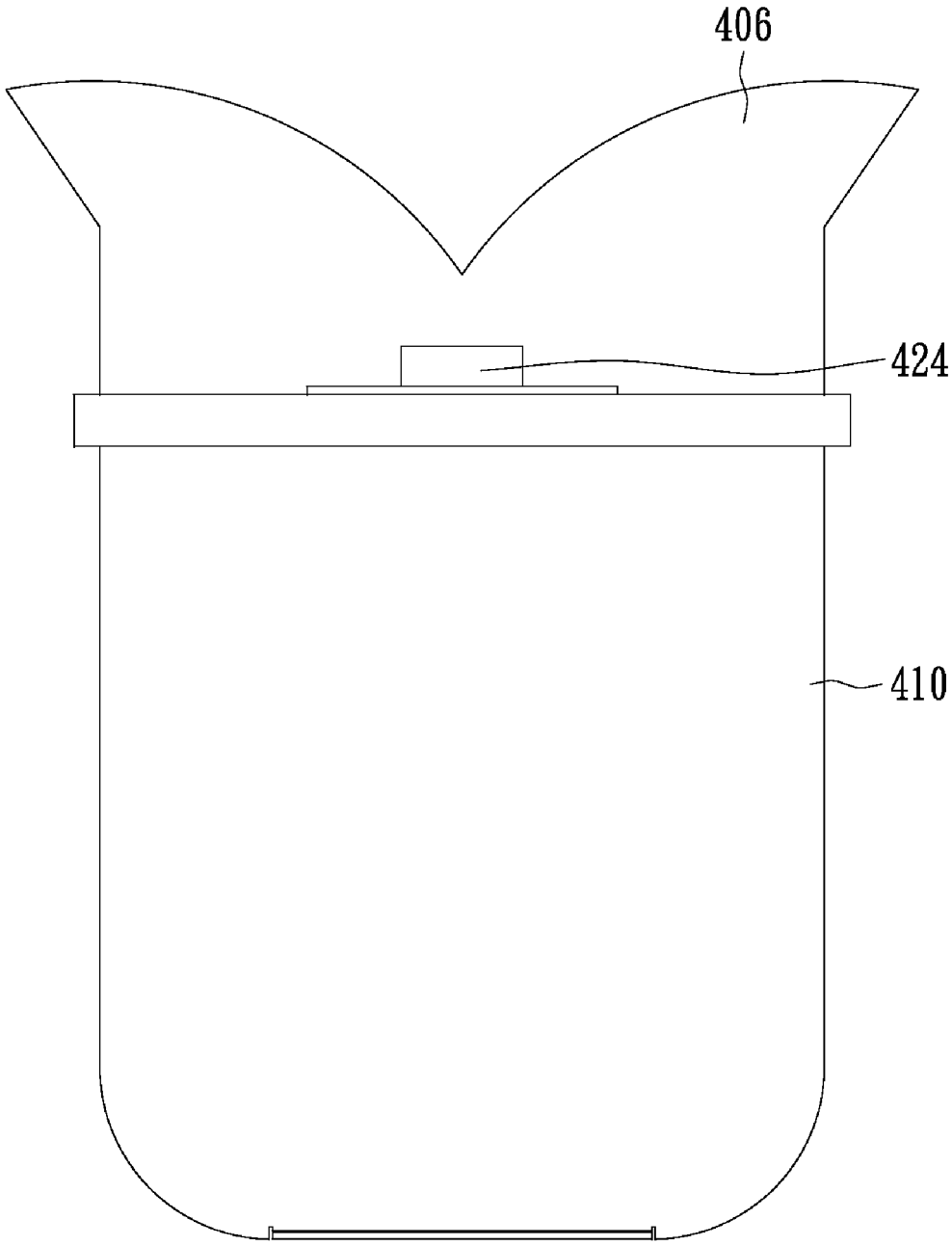

FIGS. 8 to 14 show the light guide structure of an optical element according to other embodiments of the present invention. Referring to FIG. 8, the elongated light guide structure comprises a first curved surface 802, a second curved surface 804, a first side surface 806, and a second side surface 808, wherein the first side surface 806 and the second side surface 808 are inclined surfaces. The first curved surface 802 and the second curved surface 804 are separately concaved toward the center of the LED light bar 404 from locations close to two opposite sides of the LED light bar 404 and joined to each other, wherein each of the first curved surface 802 and the second curved surface 804 is tangent to a plane including a positive optical axis of the LED light bar 404 at an angle. The positive optical axis is defined as the direction perpendicular to the plane on which light emitting diodes 424 are disposed. The light emitted from the light emitting diodes 424 is incident on the first curved surface 802, the second curved surface 804, the first side surface 806, and the second side surface 808. Because the incident angles are greater than the critical angle, the light is reflected. For example, the light 810 that is incident to the first curved surface 802 is totally reflected so that the propagation direction of the light 810 is changed to project through the first side surface 806. The light 812 that is incident to the second curved surface 808 is totally reflected so that the propagation direction of the light 812 is changed to project through the second side surface 808. Laterally projecting light from the first and second side surfaces 806 and 808 can be reflected by the reflecting plates 106 along the optical axis.

Figure 13:
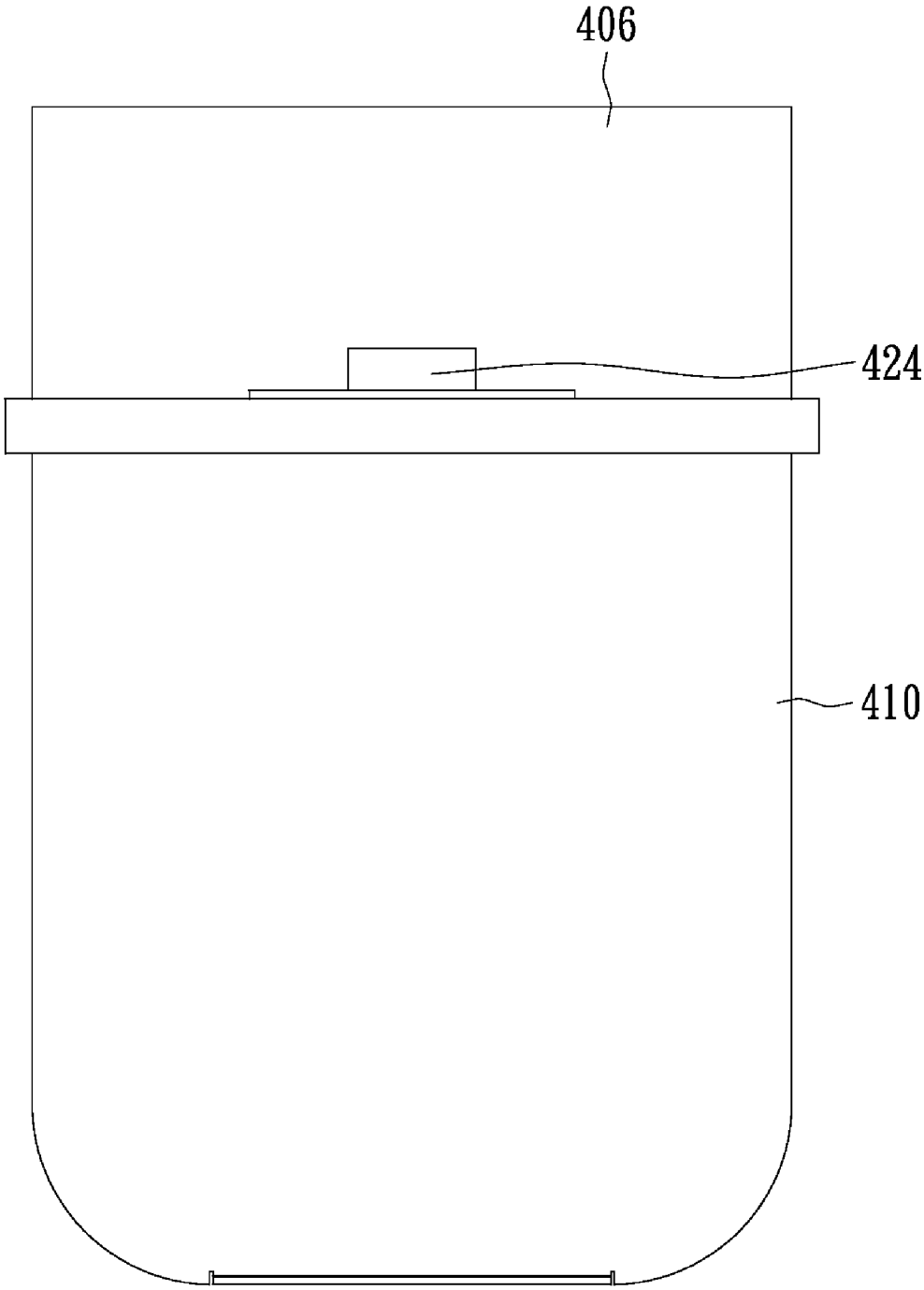
Figure 14:
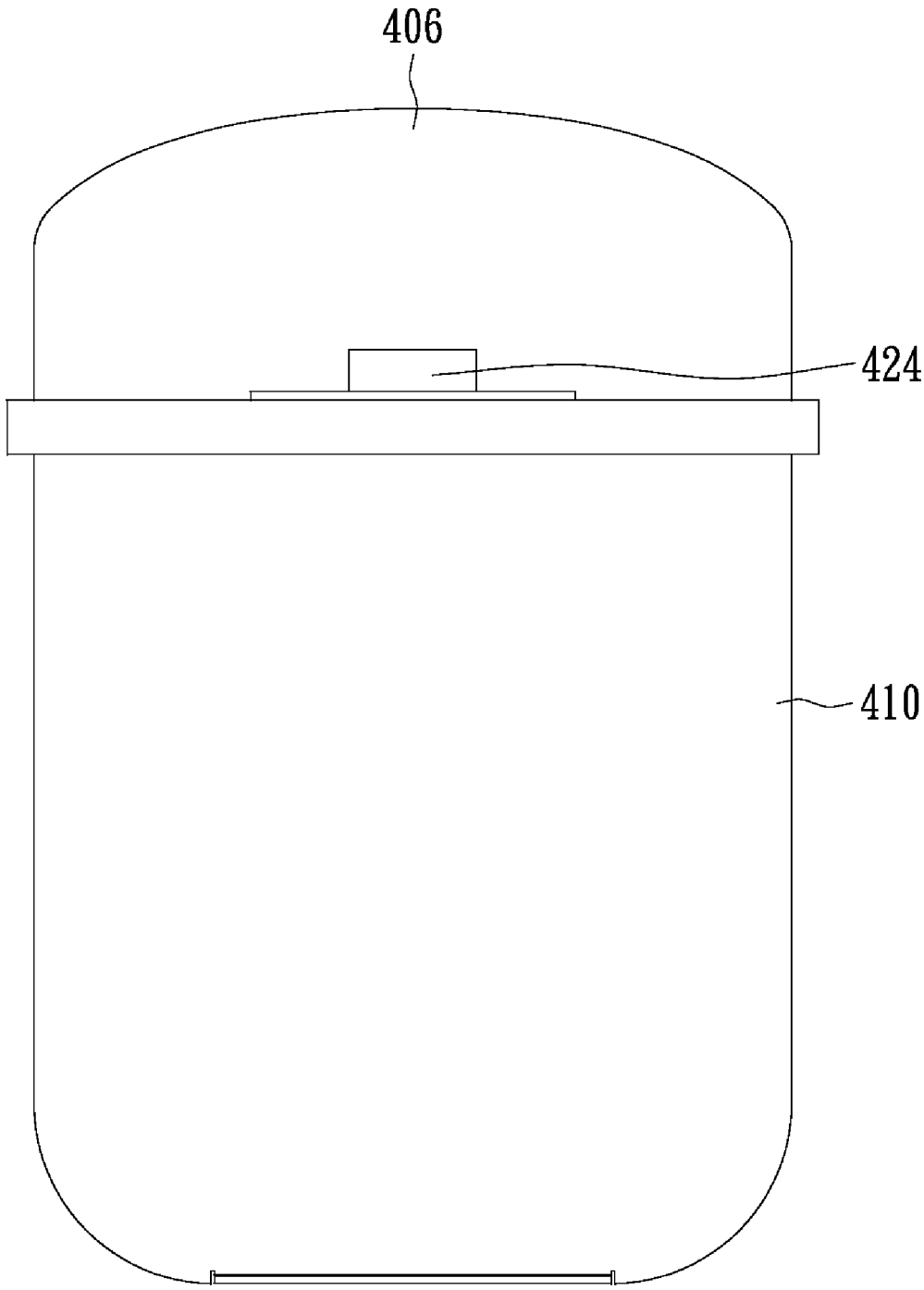

The cross section (as shown in FIGS. 8 to 14) of the light guide structure of the optical element 406 can be changed to meet the requirement of the desired light distribution patterns. The light distribution patterns can be those that are specified in the road lighting specifications for domestic urban main road illumination, high-speed road illumination, and road illumination in business areas. In addition to including a plurality of curved surfaces, the light guide structure can include a simple shape such as a rectangular shape as shown in FIG. 13 or an arc shape as shown in FIG. 14.

Figure 15:
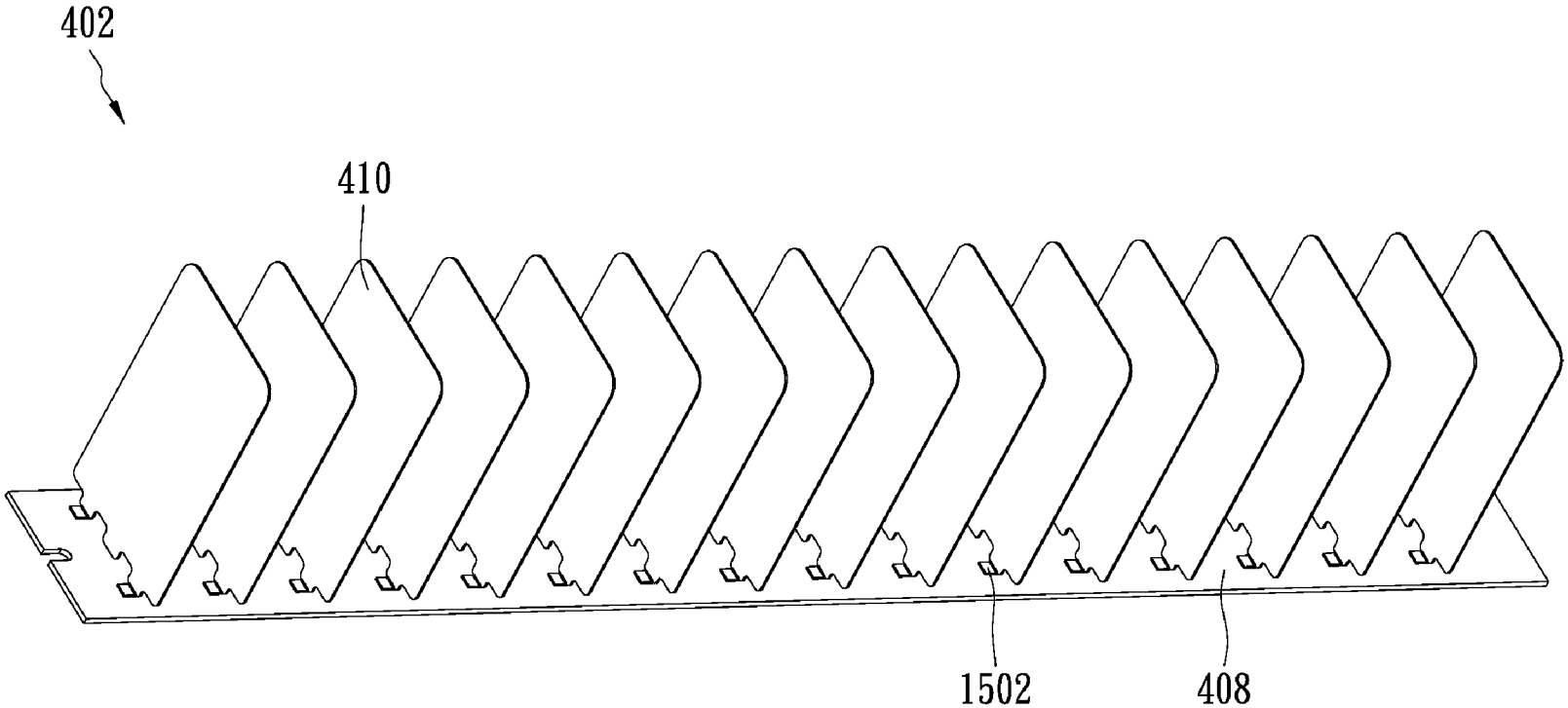
FIG. 15 is a perspective view showing a heat dissipation device according to one embodiment of the present invention.

FIG. 15 is a perspective view showing a heat dissipation device 402 according to one embodiment of the present invention. The heat dissipation device 402 comprises a base plate 408 and a plurality of fin plates 410, wherein the base plate 408 and the fin plate 410 can be two separate components. The plurality of fin plates 410 can be arrayed on the base plate 408 in an equally spaced manner. The base plate 408 and the fin plate 410 may comprise high thermally conductive material such as aluminum and copper. Each fin plate 410 can be attached by welding a fixing portion 1502 extending from an edge thereof and angled relative thereto to the based plate 408. The welding method may comprise surface mount technology. The fin plate 410 may be manufactured by stamping. The base plate 408 can be manufactured using a metal extrusion process. Because the fin plate 410 is not formed by extruding metal through an extrusion die, the thickness of the fin plate 410 can be small. For example, the thickness of a fin plate formed using a metal extrusion process is normally greater than 1 millimeter; however, the fin plate 410 of the present embodiment can be less than 1 millimeter.

The heat dissipation device 402 can be customarily manufactured according to different applications or requirements. For example, if higher fin plates 410 are needed, users can manufacture fin plates 410 with sufficient height and weld theses fin plates 410 onto the base plate 408. Further, according to experiments, the material used to manufacture the heat dissipation device 402 can be reduced by about 30 percent to obtain the same heat dissipation area. Therefore, the cost of the heat dissipation device 402 is low.

In the present embodiment, the LED light bar 100 can be fixed, using a fastener 430, to a surface of the base plate 408 opposed to the surface on which the fin plates 410 are disposed, as shown in FIG. 4, wherein between the LED light bar 100 and the base plate 408, a conductive paste (not shown) can be applied to reduce the thermal resistance between the LED light bar 100 and the base plate 408. The fastener 430 for fixing the LED light bar 100 can include a screw.

Figure 16:
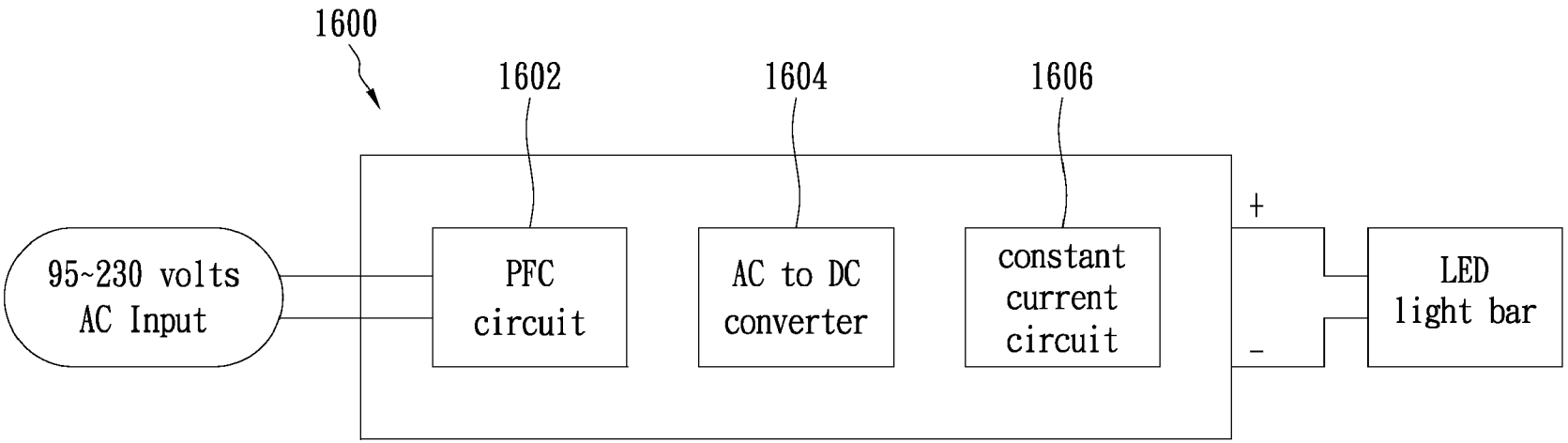
FIG. 16 is a block diagram showing a driving device for an LED light bar according to one embodiment of the present invention.

FIG. 16 is a block diagram showing a driving device 1600 for an LED light bar 100 according to one embodiment of the present invention. The driving device 1600 for an LED light bar 100 comprises a power factor correction circuit 1602, an AC-to-DC converter 1604, and a constant current circuit 1606. The driving device 1600 is configured to convert 95-230 volt power to constant current to supply the LED light bar 100, wherein the power factor correction circuit 1602 can increase power transformation efficiency and reduce the risk of damaging the public electrical network and the LED light bar 100. The power factor correction circuit 1602 may be an active power factor correction circuit or a passive power factor correction circuit. The LED light bar 100 of the present invention systematically and integrally includes a driving device 1600, and a user can only supply 100 to 230 volt power to light up the LED light bar 100.

Figure 17:
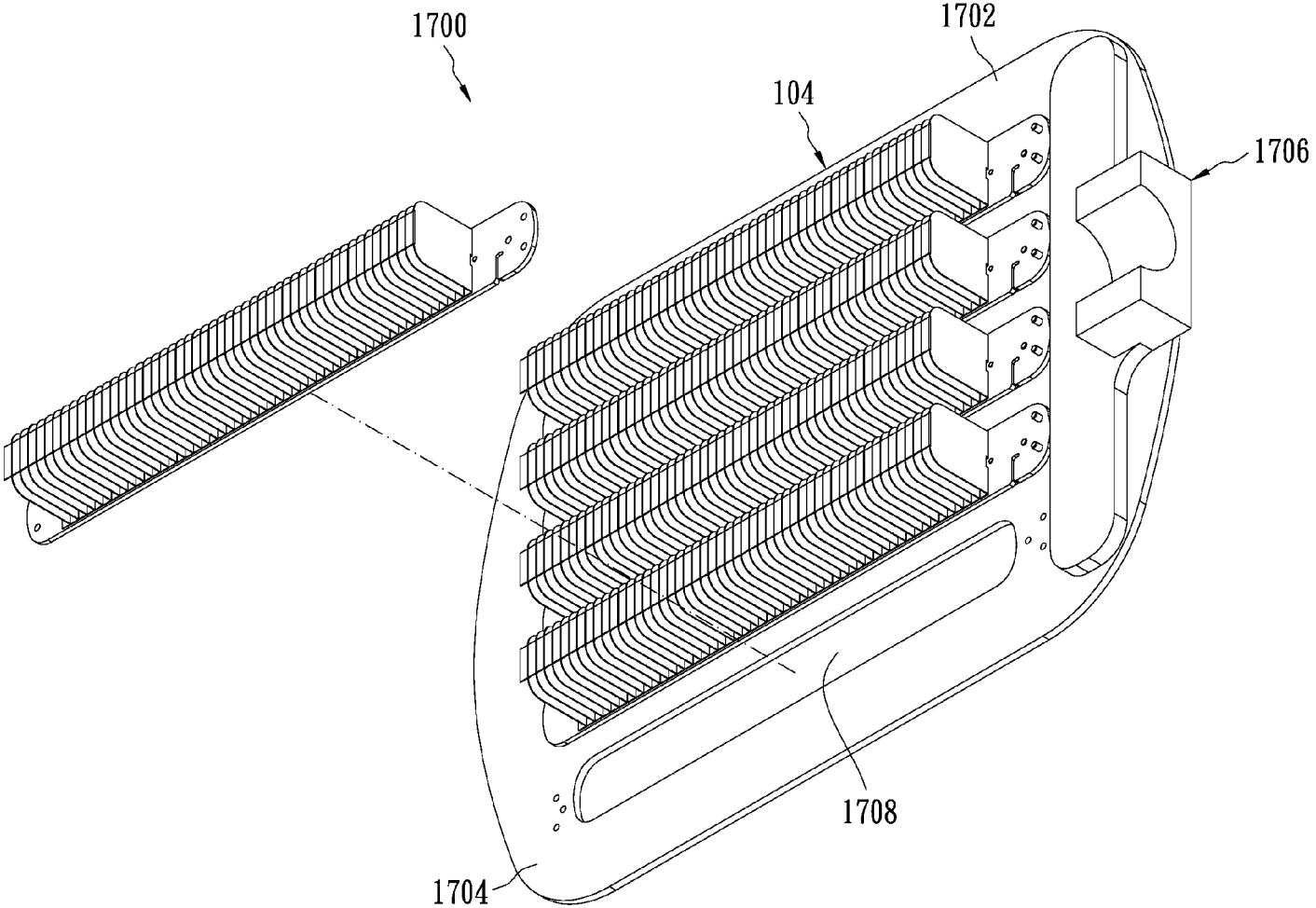
FIG. 17 is a perspective view showing an LED light module according to another embodiment of the present invention.

FIG. 17 is a perspective view showing a light emitting diode (LED) light module 1700 according to another embodiment of the present invention. The LED light module 1700 comprises a frame 1702 and a plurality of optical engines 104. The frame 1702 can be a plate like piece, including a plurality of through grooves 1708 disposed with respect to the optical engines 104. Each through groove 1708 allows light emitting diodes (not shown) to protrude beyond a surface of the frame 1702 opposite the assembly surface. At a side of the frame 1702 in the longitudinal direction of the optical engine 104, a support member 1706 can be disposed for supporting the LED light module 1700. The frame 1702 can comprise metal such as aluminum, copper, iron, iron alloy, aluminum magnesium alloy and stainless steel.

Figure 18:
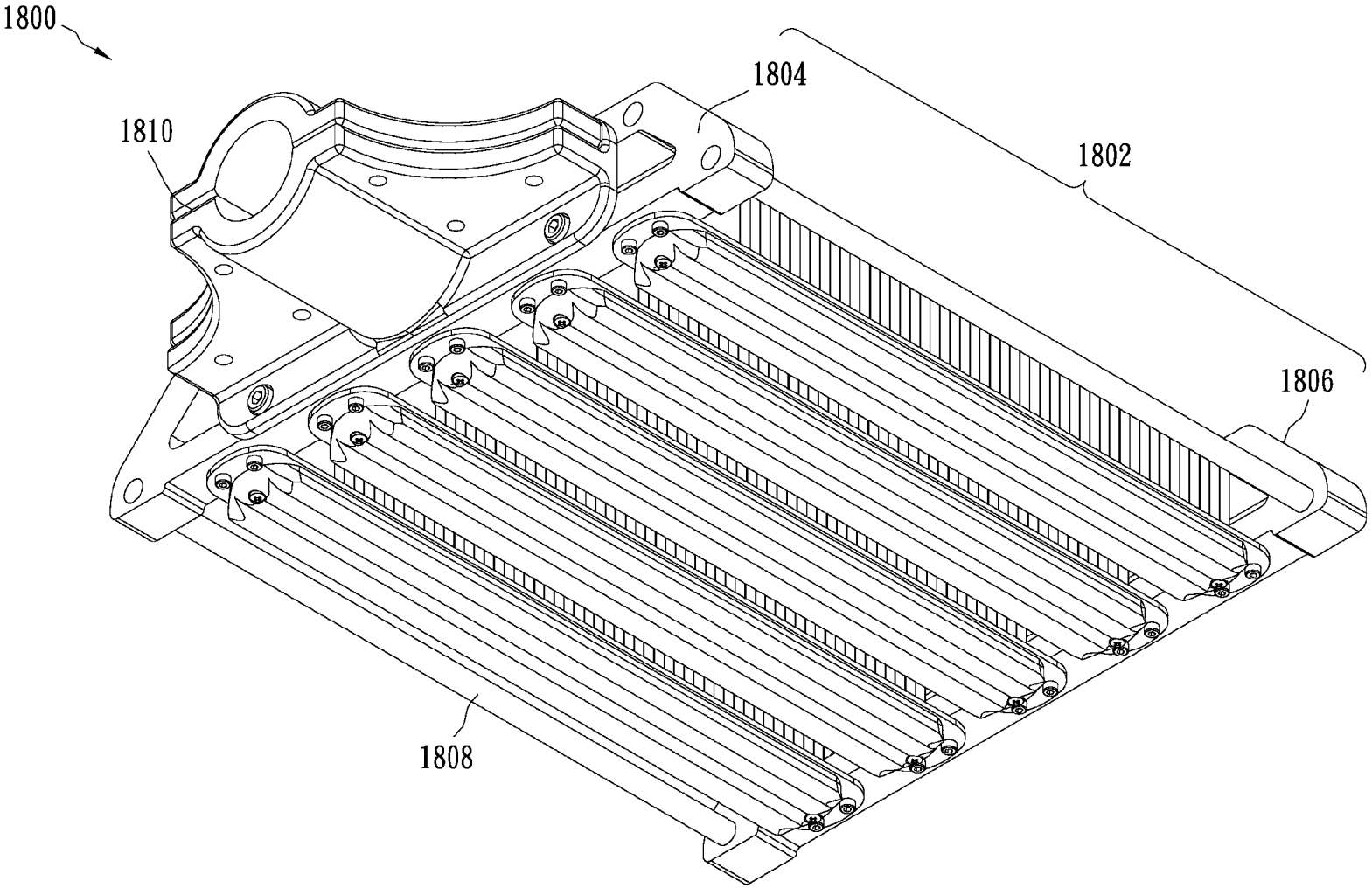
FIG. 18 is a perspective view showing an LED light module according to another embodiment of the present invention.

FIG. 18 is a perspective view showing a light emitting diode (LED) light module 1800 according to another embodiment of the present invention. The LED light module 1800 comprises a frame 1802 and a plurality of optical engines 104. The frame 1802 comprises two support elements 1804 and 1806. Two end portions of each optical engine 104 are fixed onto the spaced and parallel disposed two support elements 1804 and 1806 to form the LED light module 1800. The LED light module 1800 has advantages of simple design (merely requiring to fix the two end portions of each optical engine 104), easy expansion (the lengths of the support elements 1804 and 1806 can be arbitrarily cut without requirement of further manufacture processes), and light weight. To increase the connection strength between the support elements 1804 and 1806, a rod 1808 can be provided. The support elements 1804 and 1806 may comprise metal, preferably a lightweight metal. The rod 1808 can use metal having higher strength for providing high connection strength. Such a design arrangement can allow the LED light module 1800 to be of light weight. One of the support elements 1804 and 1806 can include a support member 1810 for supporting the LED light module 1800.

The above-described embodiments of the present invention are intended to be illustrative only. Numerous alternative embodiments may be devised by persons skilled in the art without departing from the scope of the following claims.

What is claimed is:

1. An optical engine of an LED (light emitting diode) light module, comprising:

a heat dissipation device comprising a base plate and a plurality of fin plates vertically disposed on a surface of said base plate;

an LED light bar disposed on an opposite surface of said base plate, thereby dissipating heat through said heat dissipation device;

an optical component having a space for receiving said LED light bar, configured for provision of a predetermined light distribution pattern; and an encapsulating adhesive filled in said space.

2. The optical engine of claim 1, wherein said fin plate is formed by stamping an aluminum sheet or a copper sheet.

3. The optical engine of claim 1, wherein said fin plate and said base plate are welded using a material selected from the group consisting of gold, silver, nickel-gold alloy, palladium-nickel alloy, tin, tin-silver alloy, tin-copper, and tin-silver-copper alloy.

4. The optical engine of claim 1, wherein said fin plate is surface mounted on said base plate.

5. The optical engine of claim 1, wherein said LED light bar comprises a metal core printed circuit board.

6. The optical engine of claim 1, wherein the refractive index of said encapsulating adhesive is between the refractive index of the encapsulating adhesive in the light emitting diode of said LED light bar and the refractive index of said optical component.

7. The optical engine of claim 1, further comprising a driving device for driving said LED light bar.

8. The optical engine of claim 1, wherein said optical component comprises an elongated light guide structure having a first curved surface and a second curved surface separately concaved toward the center of said LED light bar from locations close to two opposite sides of said LED light bar and joined to each other, wherein each of said first curved surface and said second curved surface is tangent to a plane including an optical axis of said LED light bar at an angle.

9. The optical engine of claim 8, wherein said light guide structure comprises a first side surface and a second side surface, wherein said first surface and said second surface are inclined surfaces.

10. An optical engine of an LED (light emitting diode) light module, comprising:

a heat dissipation device comprising a base plate and a plurality of fin plates vertically disposed on a surface of said base plate;

an LED light bar disposed on an opposite surface of said base plate, thereby dissipating heat through said heat dissipation device; and an optical component having a space for receiving said LED light bar, configured for provision of a predetermined light distribution pattern;

wherein said optical component comprises an elongated light guide structure having a first curved surface and a second curved surface separately concaved toward the center of said LED light bar from locations close to two opposite sides of said LED light bar and joined to each other, wherein each of said first curved surface and said second curved surface is tangent to a plane including an optical axis of said LED light bar at an angle.

11. An LED light module, comprising:

a frame comprising a plurality of reflecting plates protruding from a surface of said frame and a plurality of hollowed-out regions formed on said frame, wherein said plurality of reflecting plates are arrayed along a direction transverse to the longitudinal direction of the reflecting plates, and said hollowed-out regions are respectively formed between every two adjacent reflecting plates; and a plurality of optical engines correspondingly disposed in said hollowed-out regions, each optical engine comprising:

a heat dissipation device comprising a base plate and a plurality of fin plates vertically disposed on a surface of said base plate;

an LED light bar disposed on an opposite surface of said base plate, thereby dissipating heat through said heat dissipation device; and an optical component having a space for receiving said LED light bar, configured for provision of a predetermined light distribution pattern;

wherein any two of said reflecting plates reflect light projecting laterally from said respective optical engine disposed therebetween in a direction along the positive optical axis of said respective optical engine.

12. The LED light module of claim 11, wherein each reflecting plate has two reflecting surfaces, and said two reflecting surfaces are two inclined surfaces or a straight surface and an inclined surface, wherein said reflecting surface is a polished aluminum surface.

13. The LED light module of claim 11, wherein said frame is formed using a stamping process or is assembled from a plurality of extruded aluminum elements, wherein said fin plate is formed by stamping an aluminum sheet or a copper sheet, wherein said fin plate and said base plate are welded using a material selected from the group consisting of gold, silver, nickel-gold alloy, palladium-nickel alloy, tin, tin-silver alloy, tincopper, and tin-silver-copper alloy.

14. The LED light module of claim 11, wherein said fin plate is surface mounted on said base plate.

15. The LED light module of claim 11, further comprising an encapsulating adhesive filled in said space, wherein the refractive index of said encapsulating adhesive is between the refractive index of the encapsulating adhesive in the light emitting diode of said LED light bar and the refractive index of said optical component.

16. The LED light module of claim 11, further comprising a driving device for driving said LED light bar.

17. The LED light module of claim 11, wherein said optical component comprises an elongated light guide structure having a first curved surface and a second curved surface separately concaved toward the center of said LED light bar from locations close to two opposite sides of said LED light bar and joined to each other, wherein each of said first curved surface and said second curved surface is tangent to a plane including an optical axis of said LED light bar at an angle.

18. The LED light module of claim 17, wherein said light guide structure comprises a first side surface and a second side surface, wherein said first surface and said second surface are inclined surfaces.

19. The LED light module of claim 11, wherein said frame comprises a plate-like structure, and said hollowed-out region is a through groove.

20. The LED light module of claim 11, wherein said frame comprises two supporting members spaced apart from each other, and the two end portions of each of said plurality of optical engines are respectively attached to said two supporting members.

* * * * *